US005133643A

United States Patent [19]

Ortolano

[11] Patent Number: 5,133,643

[45] Date of Patent: Jul. 28, 1992

[54] SHROUD FITTING

[76] Inventor: Ralph J. Ortolano, 3776 Coolheights Dr., Rancho Palos Verdes, Calif. 90274

[21] Appl. No.: 440,238

[22] Filed: Nov. 22, 1989

[51] Int. Cl.[5] ..... F01D 5/22

[52] U.S. Cl. ..... 416/195; 29/281.1; 29/281.5; 29/889.21; 269/43

[58] Field of Search ..... 415/148, 150, 159, 160, 415/161, 162, 163, 164, 189, 190, 195, 209.2, 209.3, 191; 416/181, 189, 191, 192, 194, 195, 220 R; 29/889.21, 889.22, 281.1, 281.5; 269/43, 287, 909

[56] References Cited

U.S. PATENT DOCUMENTS

| | | | |
|---|---|---|---|
| 3,279,751 | 10/1966 | Ortolano | 416/220 R |
| 3,417,964 | 12/1968 | Ortolano | 416/220 R |
| 3,503,696 | 3/1970 | Bauger et al. | 269/287 |
| 4,066,384 | 1/1978 | DiFerdinando | 416/195 |
| 4,482,297 | 11/1984 | Mosimann et al. | 416/218 |
| 4,732,536 | 3/1988 | Lejars et al. | 415/160 |

FOREIGN PATENT DOCUMENTS

| | | | |
|---|---|---|---|
| 844 | 1/1972 | Japan | 416/195 |
| 232578 | 8/1925 | United Kingdom | 416/195 |
| 377101 | 7/1932 | United Kingdom | 416/195 |

*Primary Examiner*—John T. Kwon
*Attorney, Agent, or Firm*—Charles Berman

[57] ABSTRACT

Fitting a shroud band to the tenons located at the tips of a blade of a turbine uses a jig. The precise location of the tenons relative to pitch, radial and axial location is determined by fingers which can interlock with an elongated segment. The fingers have apertures which define the position of the tenons. The apertures in the fingers are transferred to a shroud band into which apertures are formed. The shroud band is progressively apertured to form a long arc shroud for adjacent blades of the turbine.

40 Claims, 4 Drawing Sheets

SHROUD FITTING

BACKGROUND

The tips of blades of a turbine need to be shrouded for a number of reasons. These include:

(a) preventing steam from leaking out the blade tips,
(b) acting as a sealing surface,
(c) permitting tuning of blade frequencies,
(d) reducing the bending moment at the blade base and fastening,
(e) increasing mechanical damping of blade vibrations, and
(f) attenuating totally some resonant modes of vibration.

This invention relates to providing a long arc shroud to tenons located at the tips of the blades such that the pitch of the blades can be accurately related to the shroud.

The extremely accurate measurement of the relative position of blade tenons on steam turbine blades has not been necessary when the shroud or cover groupings are small, namely 12 or less holes per segment, because errors made during the measurement process are cancelled at the end of each segment. Thus, small errors in measurement have persisted and are generally tolerable. With long arc shrouding, measurement errors must be avoided, since they can be cumulative and excessive. This can cause unacceptable distortion of the blades, increasing in magnitude as the distance from the center of the arc is increased.

Properly sized long arc covers can be considerably longer than the typically used short arc covers. For example, on four different rows of blades, the number of holes in each segment changed from 4 to 25, 5 to 43, 6 to 26, 7 to 73 and 6 to 91. The purpose of this substantial change in arc length is to suppress the tangential in-phase mode of vibration, which has most frequently been the cause of blade fatigue failures. The benefits of long arcs, harmonic arcs, and continuous harmonic arcs have been described previously.

One of the most accurate ways to locate the tenon holes in a shroud or cover is to place the segment directly on the blade tips next to the projecting tenons. The tenon pitches can then be transferred directly to the part. This technique has been used for many years where cylindrical blade tips have been used. The band is rolled to follow the curvature of the blade tips and is tightly held in place to either the leading or trailing tip surfaces while the pitches are transferred to the blued outer surface of the band using a machinist's square. Axial misalignment and rotational variations in the tenons can also be transferred at this time.

With conical blade tips, a degree of error occurs when pitches are transferred in a similar manner. This can generally be tolerated for short segment designs. The shroud, band or cover is a segment of a conical surface, machined from flat stock and then rolled to the desired tip curvature. Pitch error is caused by transferring the pitch at the top of the tenons instead of the bottom of the tenon.

Conical tip blades can have any of three types of tenon attached bands. The outer surface of the band can be parallel with the inner surface of the band which is typical of most GE (Trademark) designs. Alternatively the outer surface of the band has a shallower angle than the inner surface of the band as in some Westinghouse (Trademark) designs. Yet further the outer surface of the band can be cylindrical and the inner surface of the band conical, as is used on many Westinghouse Marine Division designed rows.

Conical bands in which the inner and outer surfaces are parallel are usually made by one of two methods. Short arc segments are usually cut from plate in a crescent-shaped conic section and rolled to the proper curvature after the holes have been made. Long arc segments are usually made by edge rolling strip stock. This causes the material to curve crescent shaped. It is then rolled to the proper curvature, whereupon it becomes a conic segment. With either of these configurations, accurate measurement or transfer of pitches is difficult.

A pitch measurement taken for example, at the top of the tenons introduces an error of 5 mils/blade. For a six-blade group, this amounts to a 0.030", which distributed equally produces a maximum distortion of 0.015" at the end blades of the group. On a 73-blade (120 degree arc segment) group, this error amounts to 0.365", or 0.183" at the end blades. This amount of distortion is unacceptable and would most likely cause premature failure of the tenons. Similar error occurs if the pitches are taken by placing the shroud on the admission or discharge conical surfaces adjacent to the tenons.

Changes occur in the shroud pitches due to punching, riveting, and shroud machining. Changes which occur after the pitches are transferred produce an error, which if excessive or left uncompensated, can cause excessive distortion stress.

An objective of the invention is to provide for accurately locating tenon holes particularly in long arc conical bands.

SUMMARY

The objective is achieved with the device and method of the present invention.

According to the invention a jig comprises an elongated segment with a plurality of fingers extendable transversely from the segment. The jig fingers interact with tenons located at the tips of the blade of a turbine. Apertures in the fingers interengage with the tenons. Means releasably interlocks the fingers with the elongated segment, so that when the fingers are locked, apertures in the fingers define the relative location of the different tenons. The defined locations include the pitch between adjacent tenons and the radial and axial locations between adjacent tenons.

After locating the fingers in position the apertures are demarcated onto a shroud or band so that the relative location of the apertures of the fingers is transferred to the shroud or band. Apertures are then formed in the shroud which conform accurately to the location of the tenons on the tips of the blades.

The device is progressively used to form long shrouds and the leading blade of any particular group of blade tips become the trailing blade of an adjacent blade group. Adjustment for movement or growth due to punching, riveting or machining of the shroud is effected by moving the band towards the adjacent previously transferred set of tenons on the band.

The jig, which is a pitch transfer device, allows for accurate pitch transfer with long arc covers on conical or cylindrical blade tips. The pitch transfer method is used to transfer the location of tenons of blade tips from a conical surface to another conical surface, or from a conical surface to flat stock having a conical arc. In addition, the device also allows transfer of axial and rotational variations in tenon alignment. An important additional characteristic of the pitch transfer device is that anticipated pitch changes or growth can be incorporated during the transfer process to produce a level of accuracy previously unattainable.

The invention is now further described with reference to the accompanying drawings.

DRAWINGS

DESCRIPTION

Figures 2, 3:
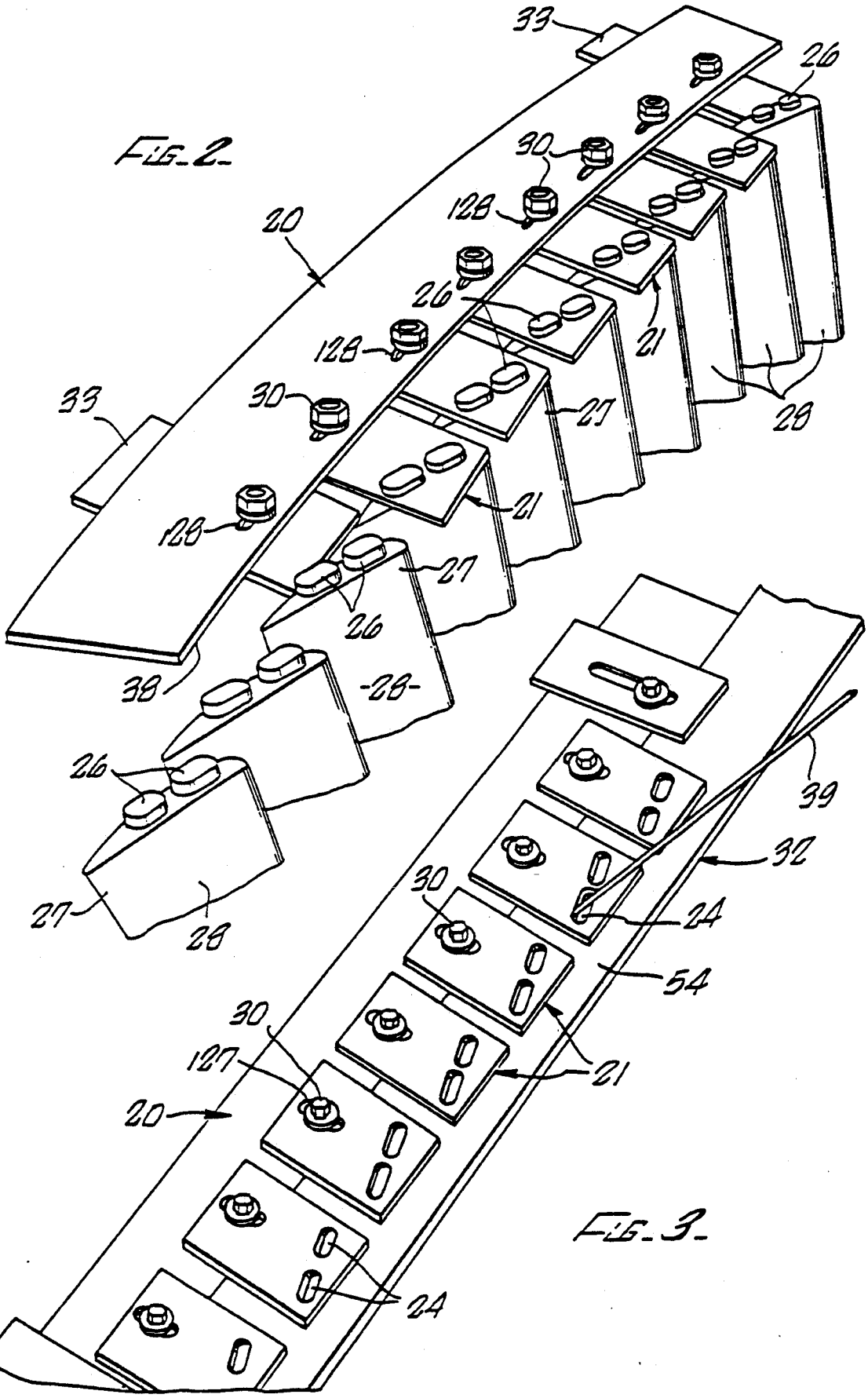
FIG. 2 is a perspective view of the jig in location on the tips of adjacent blades of a turbine in a mode measuring the locations of the various tenons, the fingers being located below the elongated segment.
FIG. 3 is a perspective view illustrating the transfer of the measured location of the tenons to a band or shroud, the fingers being shown above the elongated segment.

A jig or pitch transfer device for interaction with tenons located at the tips of the blades of a turbine includes an elongated segment 20. A plurality of spaced fingers 21 are arranged on the longitudinal direction 22 of the elongated segment 20. There is a longitudinal axis 23 for the elongated segment 20. Apertures 24 are provided towards the one end 25 of the fingers 21. The apertures 24 are for interengagement with tenons 26 at the tips 27 of blades 28 of a turbine, such as a steam turbine. The blades 28 are arranged in radially adjacent location about a central axis for the turbine. This is illustrated in FIG. 2.

At the opposite end 126 of the fingers 21 there is located a slot 127 which is longitudinally directed parallel to the longitudinal direction of the fingers 21. There is a transverse slot 128 in the elongated segment 20, the transverse slot 128 being parallel to axis 23 of the elongated segment 20. Nut and bolt interlocking means 29 is used to interlock the fingers 21 with the elongated segment 20. The bolt 30 extends transversely through the elongated segment 20 and the fingers 21. A nut 31 is used to secure the fingers 21 with the elongated segment 20. In this manner the apertures 24 can be used to define the relative location of the different tenons 26.

Figure 1:
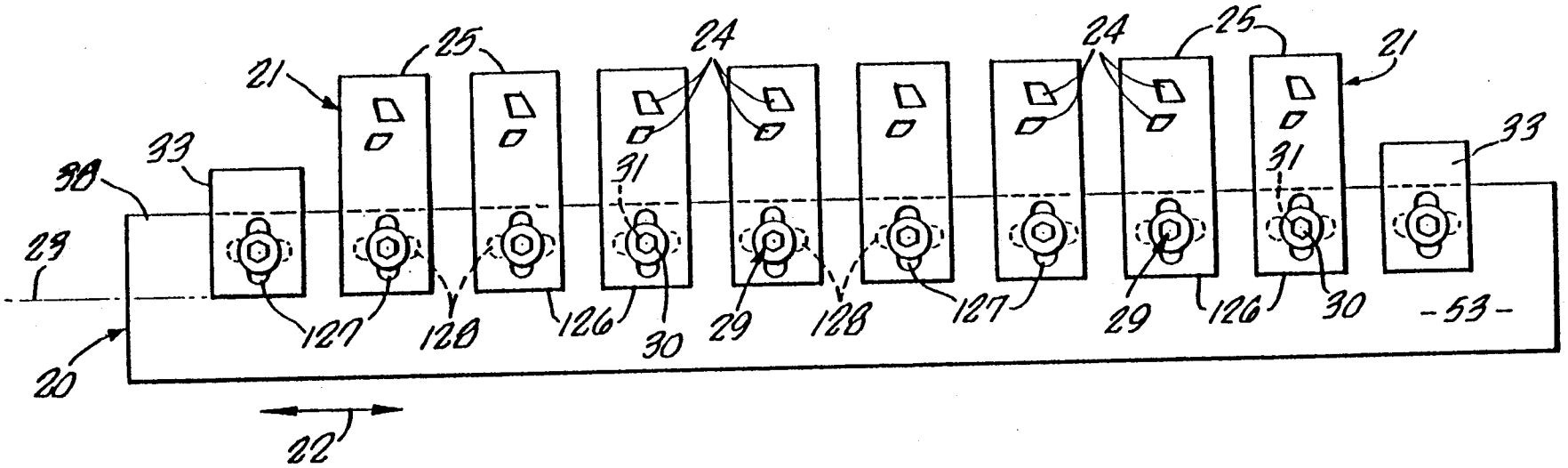
FIG. 1 is a top plan view of a jig shown with the fingers on top of the elongated segment viewed from the concave side of the elongated segment.

The relative locations of the different tenons 26 define a pitch between the adjacent tenons 26 and also the radial and axial location or misalignment between the adjacent tenons 26. As illustrated in FIG. 1 the fingers 21 have a pair of apertures 24 at the end 25 of each of the fingers 21. In different embodiments there may only be a single aperture 24 in each finger 21, and enlarged holes may be used in lieu of slots 127 and 128.

The elongated segment 20 is selectively a rigid curved element to conform to the curvature of adjacent blade tips 27 at the periphery about the blades. Alternatively the elongated segment is a flexible element conforming to the blade tip 27 periphery curvature when located at the tips 27 of the blades 28. After conforming to the curvature, the elongated segment 20 can be located flat for interengagement with a flat shroud or band 32 for the blades 28. Thereafter curvature is imparted to the shroud or band 32 when located with the tenons 26.

As illustrated, the jig or pitch transfer device includes eight spaced fingers along the elongated segment 20. At each of the extremities of the elongated segment 20 there are respectively reference alignment fingers 33 which are used for abutment with an adjacent edge of the tenons 26 to facilitate accurate alignment of the jig with the tenons 26.

The spaced fingers 21 are formed of a plate and have a surface 37 for location on the peripheral surface 34 of the blade tips 27. The apertures 24 are provided with a chamfer 35 which conforms to the radius of a fillet 36 of the tenons 26 relative to the surface 37 at the blade tip 27. In this manner the fingers 21 can be laid flush with the surface 34 and 37 in conforming location. This provides for accurate measurement of the location of tenons 26.

In use of the jig the elongated segment 20 is set up with the straight edge 38 against the surface 39 of the blades 28. The fingers 21 are placed over the tenons 26 and the nut 31 and bolt means 29 is tightened so that the fingers 21 are interlocked with the elongated segment 20. In this fashion the spaced fingers 21 accurately determine the location of the various tenons 26.

In this manner the measured pitch, axial, and rotational orientation of the tenons 26 is lifted. The jig is then turned over about its longitudinal axis 23 so that the fingers 21 are located below elongated segment 20. When lifting or measuring the pitch the fingers 21 are located above the elongated segment 20. With the jig in the position having the fingers 21 above the elongated segment, the pitch is transferred to the shroud or band 32. A scribe instrument 39 or a tenon-shaped stamp is used to mark the location of the apertures on the band 32. Apertures are then formed in the band 32 by a suitable punching or milling process. Progressively, apertures are formed in the band 32 to constitute a long shroud arc. The trailing position 41 of a jig overlaps the leading position 42 of an adjacent jig location.

As the various tenons holes are punched in the band a growth develops in the band. Compensation for this change is achieved by progressively moving each jig location as indicated arrow 43 towards the leading end of an adjacent jig location. This is effected prior to demarcating the position of the tenons 26 as illustrated. The adjustment is a predetermined amount, usually about 0.001" per aperture 24.

Figure 6:
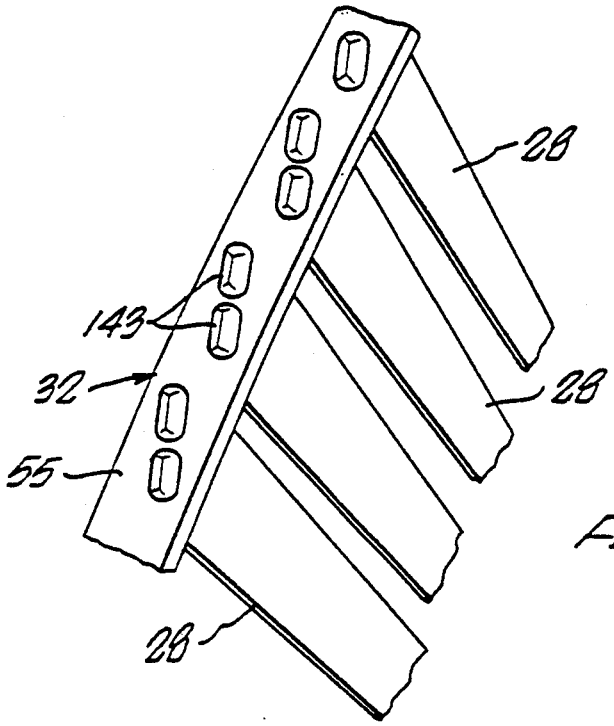
FIG. 6 is a partial view showing the tips of the tenons peened on the shroud.
Figure 7:
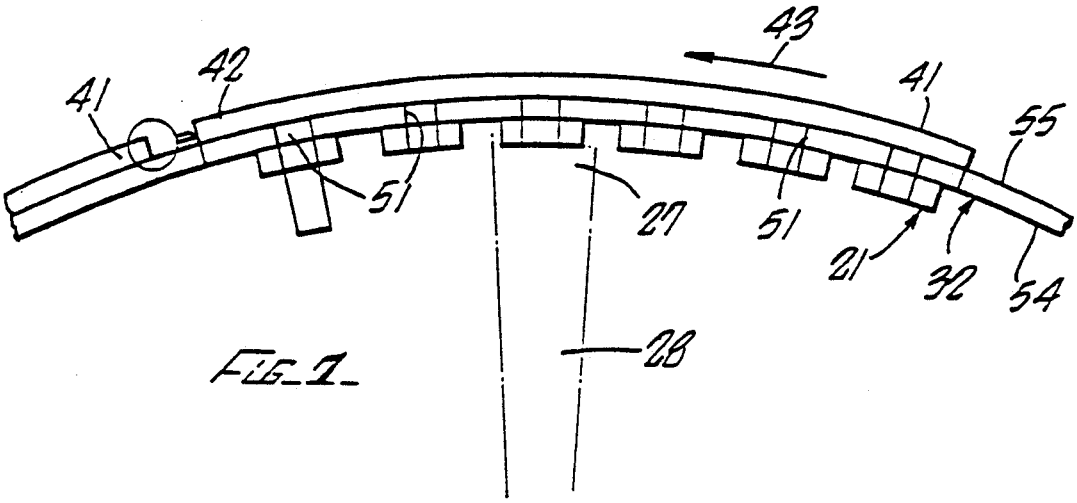
FIG. 7 is a diagrammatic view showing the shroud and elongated segment on the tips of multiple tenons and illustrating the mode for adjustment of the elongated segment band relative to the tenons.
Figure 8:
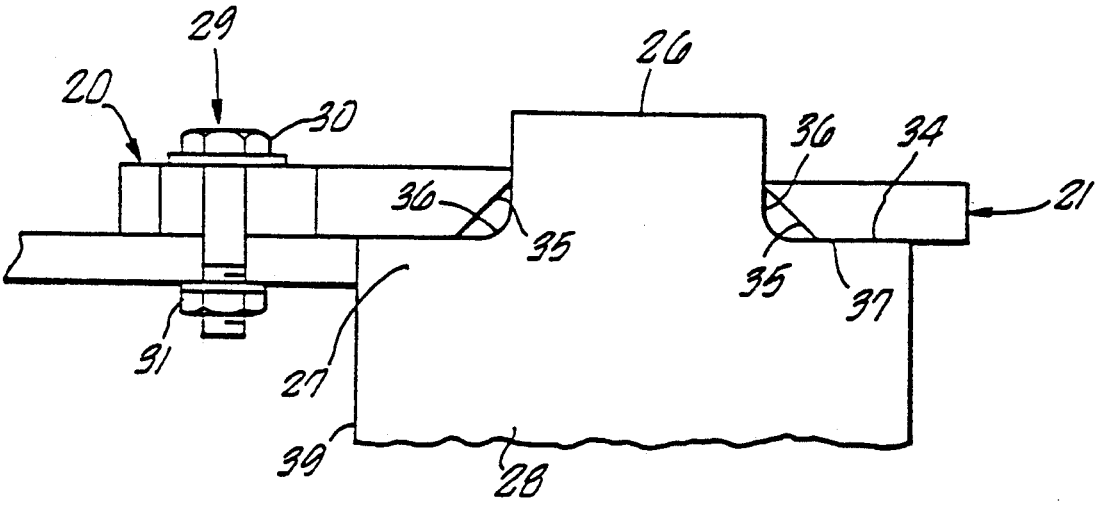
FIG. 8 is a diagrammatic end view showing the cross-section of a cylindrical blade.
Figure 9:
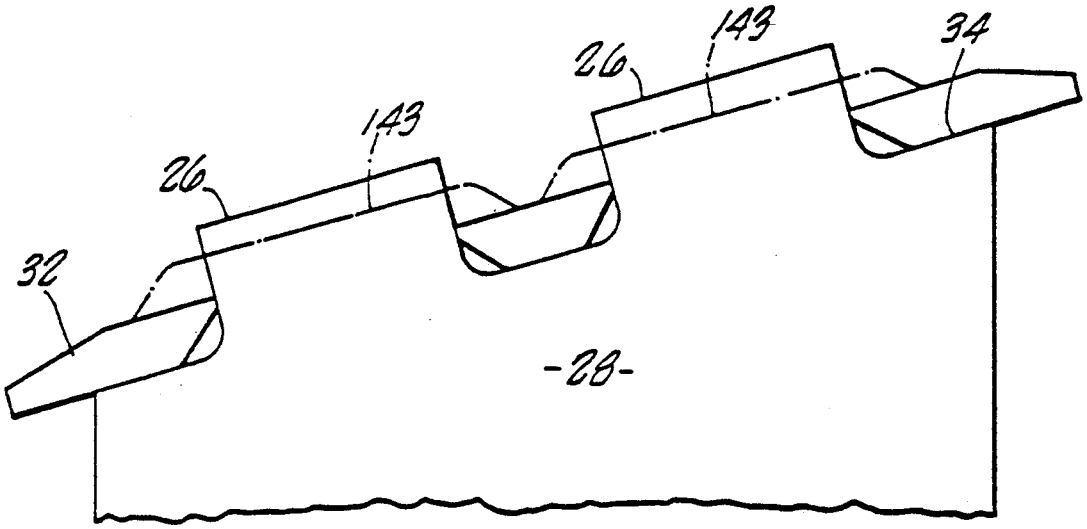
FIG. 9 is a diagrammatic end view showing a conical end view of the tips of a blade profile.
Figure 10:
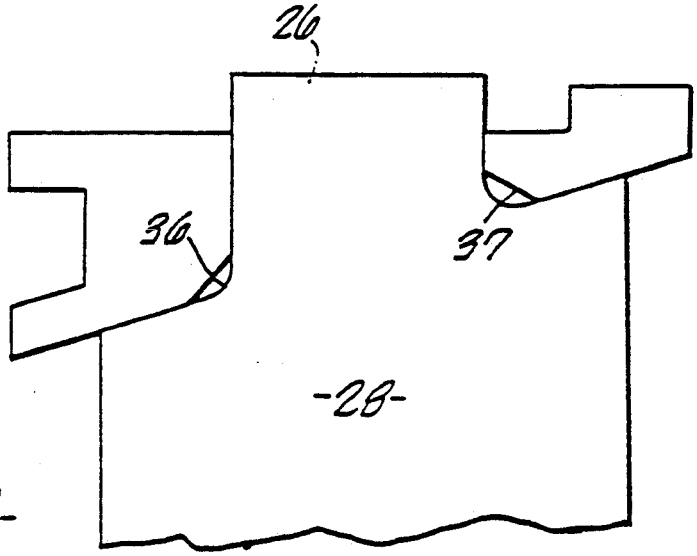
FIG. 10 is a diagrammatic end view of a different blade profile.

The technique can be used on cylindrical blade tips as illustrated in FIG. 8, conical blade tips as illustrated in FIG. 9 where the tenon tips are conical, and also for conical tips where the tenons are cylindrical as illustrated in FIG. 10. After the band is put in location over the various tenons 26 peening is effected as illustrated by the phantom line 143 in FIG. 9. This is also illustrated in the embodiment of FIG. 6.

Figure 4:
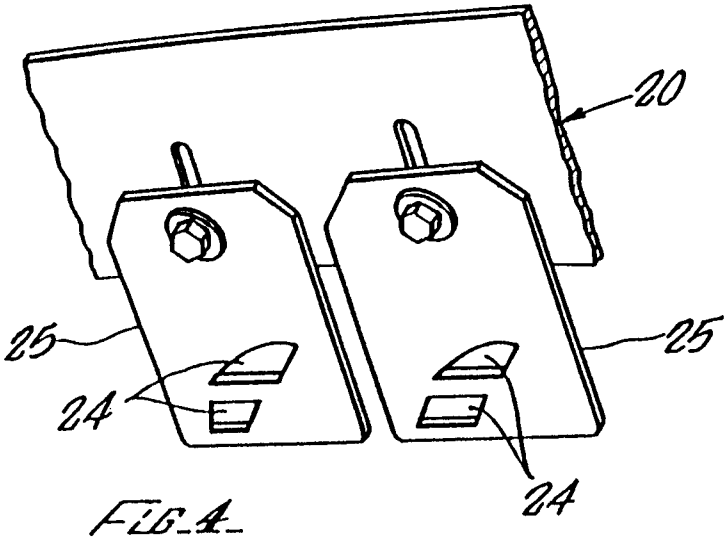
FIG. 4 is a fragmentary view of the jig illustrating the elongated segment and fingers with a first profile form of aperture in the fingers.
Figure 5:
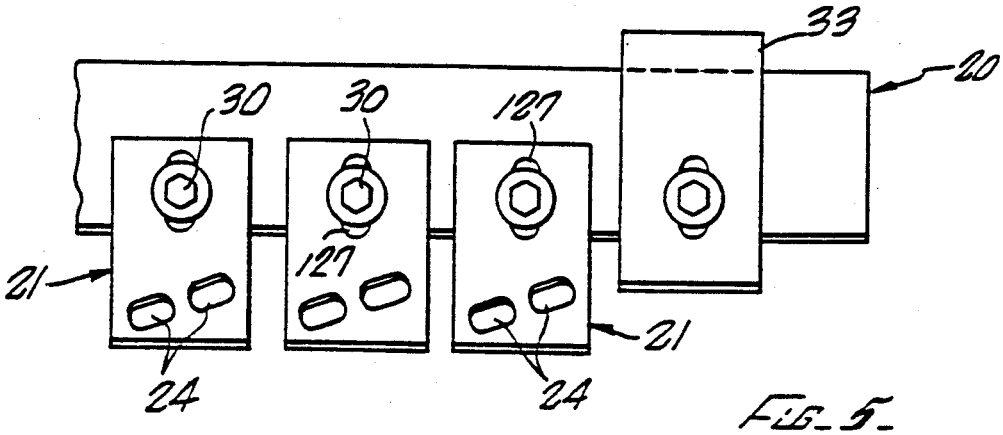
FIG. 5 is a fragmentary view of the jig illustrating a second profile form of aperture in the fingers.

The jig or pitch transfer device is of a nature that the apertures 24 can have different shapes so as to conform to different cross-sections of tenons 26. As illustrated in FIG. 4 there is a trapezoidal type of irregular shape to the apertures 24. In FIG. 5 the apertures 24 have a rectangular type of shape with curved ends. The band can be progressively moved to form a long arc to extend over 15, 40 or 60 or more blade tips so as to define an appropriately long arc shroud.

The pitch transfer device permits exact duplication of tenon positions on conical tip blades. It can also be used on cylindrical tip blades. It is particularly useful when there are tangential, axial, or rotational variations in tenon placement. The device is constructed in two basic forms; namely, a first type where pitches are transferred to curved cover segments, and a second type where pitches are transferred to flat cover segments.

If breakthrough occurs, namely widening of the hole in the band 32 where the punch leaves the material, punching should be done from the inside surface 54 outward to produce best riveting results. Holes to be milled may require flat stock for best results.

The exemplary device consists of a conical segment typically of between about five to about ten pitches long. A different device may be required for each blade configuration since the tip diameter curvature and shape of tenons 26 differ for most designs. However, once a device has been made it can be used on all identical blade designs. At the calculated ideal pitch, a slotted or enlarged hole 128 is made at each pitch location. The direction of the slot or enlargement may be varied or consistent. The number of holes can also be variable, so that the segment can have as many holes as the finished elongated segment, or as few as two holes.

At each hole, a finger 21 is attached, which has a slotted or enlarged hole 127 and a tenon hole 24 at the other end. The finger slotted hole 127 is generally 90 degrees from the segment slotted holes 128. The thickness of the finger should be at least equal to the tenon fillet radius. The width of the finger 21 should be less than the ideal pitch but with a reasonable amount of material around the tenon hole so that it does not distort during use.

For the first type of transfer; namely curved to curved, the elongated segment portion 20 of the device should be rigid, and ideally may be made from a piece of used, scrap, or practice stock. For the second type of transfer; namely curved to flat, the elongated segment portion 20 of the device should be made of thin, flexible stainless or carbon steel. On either type, each finger 21 is held in place by a bolt 30 and nut 31, wing nut, or similar tightening device.

With the fingers 21 loosely attached to the inner surface 54 of the segment 20 the device is placed over the blade tips 27, with one finger 21 engaging each tenon 26. Using the end fingers 33 to align the device to a standard reference line or surface, the nuts 31 are tightened to lock the fingers 21 against movement during the remaining transfer process.

For the first type of transfer, the device is then lifted off, turned over, and placed over the inside surface 54 of a curved segment of the band 32. It may be placed at the center, or either end of the segment of band 32. If placed at the center, two pitch transfer devices may be used simultaneously so long as they transfer pitches to the proper end of the band. The scribing tool 39 is then used to transfer the location of each finger 21 and tenon 26 to the inner surface of the band 32. Each scribed hole is then accurately aligned and the tenon hole 51 produced by punching, milling, drilling, or other suitable means. When the next set of holes 24 are transferred, the end holes are overlapped to assure accurate placement of the device. If distortion adjustments are desired, they are made during the initial placement of device for each set of holes 24.

For the second type of transfer, the fingers 21 are placed over each tenon 26 and then locked securely. The device is then lifted off and turned over, placing it on the inner surface 54 of the band 32. As the transfer device has a flexible segment 20, it lays flat. If the transferred surface is conical, the device will be crescent-shaped in the flat, and the fingers 21 will fan out when laid flat. After the locations of the holes 24 have been scribed on the band 32, the holes 51 are formed by some suitable means. As described for the first type transfer each subsequent transfer overlaps the end hole 51 to assure proper placement of the next set of transferred pitches. For both types of device, the pitch measurements are transferred to the inner surface 54 of the band when turned over.

The first type transfer method has been used to transfer 65 pitches on conical covers before riveting distortion became excessive. Distortion measurement taken during the transfer process will apply to future work to enable the assembly of longer arc segments.

Variations of the above-described procedure are applied to introduce distortion corrections if the value of the correction is known. For example, by transferring the pitches by taking them at a diameter which is less than the diameter at the outer surface of the band 34, and transferring them to the outer surface 55 of the band 32, a pitch reduction can be achieved. This pitch reduction can be as much as 0.0045" per hole or as little as "zero" per hole, for a 0.156" thick cover, 180" pitch diameter, and 218 pitches per 360 degrees. To perform this adjustment, the fingers 21 are attached to the outer surface of the segment 20 so that when they are transferred to the band 32, proper alignment can be achieved.

As the shroud or cover is punched, there may be distortion due to stretching as the punch passes through the material. In addition, on long arcs it has been detected that when the tenons are peened, additional stretching may occur. Finally, when finish machining of the shroud is performed, some of the material under distortion strain is removed, and may cause further growth. If this distortion can be measured, it can be accounted for through a compensating adjustment of the device during the pitch transfer process.

Knowing that all of these distortions cause growth, it is possible to compensate for this growth as each set of pitches is transferred to the shroud or cover stock by moving the device toward the previous set of holes punched in the band. There are numerous ways this can be done using a set of feeler gages, or it can be accomplished using a dial indicator, lead screw, cam and indicator, or similar device to accurately measure movement of the pitch measuring device.

Distortion due to the assembly of long arc shrouding is measured by comparing the pitch readings taken before and after assembly of the long arc segments at the ends of the segments. If the shrouding is held firmly in place before riveting, deflection of the end blades will give an indication of distortion due to punching. After riveting, the net distortion is measured at each end, from the last blade in the arc to the adjacent blade in the next arc, since the adjacent blade at each gap is undisturbed by the neighboring segment.

To determine the distortion produced during punching and riveting, the first piece of long arc shrouding is produced. This piece will be made using the best information available from all previous long arc shroud work. It is reasonable to assume that the shroud will grow 0.001" per hole, and may be more than 0.002" per hole depending on the thickness of the shroud, the sharpness of the punch, the size of the tenon in cross-sectional area, the clearance between the tenon and the tenon hole, the method of peening used, whether the shroud is heat treated or annealed, and possibly other factors.

Thus, the initial segment of shroud should be made with at least 0.001" per hole growth distortion correction. There are a number of ways that this correction can be made. The simplest method is to set the device in place after the second and subsequent sets of pitches are transferred, engaging the last hole of the previous set punched with the repeated pitch. The procedure is then as follows: 1) Using dowels or a mock punch, engage the finger to the punched hole. 2) Place a dial indicator at the end of the device connecting plate. 3) Set dial indicator to zero. 4) Loosen the lock nut on the overlap finger only. 5) Lightly tap the device toward the existing punched holes in the band cover until the desired movement is achieved. 6) Tighten lock nut on overlap finger and proceed with scribing tenon hole shapes on shroud.

The jig or tenon transfer device and method of the invention is used to provide for the accurate transfer of tenons to the shroud. As such, long arc shrouds can be formed which are accurately located relative to the blade tips. This minimizes stress in the turbine blades and shroud and permits for long term operation of the turbine parts.

Many other examples of invention exist each differing from the other in matters of detail only. The scope of the invention is to be determined by the following claims.

I claim:

1. A jig from interaction with tenons located at the tips of blades of a turbine comprising an elongated segment, a plurality of fingers extendable transversely from the segment, the fingers being spaced along the length of the elongated segment at a spacing to conform generally with spacing between the tenons, apertures in the fingers for interengagement with the tenons, and means for releasably interlocking the fingers with the elongated segment such that when the fingers are locked with the elongated segment, the apertures in the fingers define the relative location of the different tenons, and wherein in a locked relationship, the fingers are non-movable relative to the elongated segment.

2. A jig as claimed in claim 1 wherein the relative location defines the pitch between adjacent tenons, the tenons being non-movable relative to each other and wherein the pitch between the adjacent tenons is transferred to the interlocked fingers.

3. A jig as claimed in claim 2 wherein the radial location and axial location between adjacent tenons is defined by the fingers.

4. A jig as claimed in claim 1 wherein the fingers have apertures to conform with the cross-section of the tenons.

5. A jig as claimed in claim 4 wherein the apertures are formed in a plate having a surface, the apertures having a chamfer about the perimeter at the interaction between the surface of the plate such as to permit location of the surface against a blade tip, and the tenons extending from the blade tip.

6. A jig as claimed in claim 5 wherein the depth of the chamfer is at least equal to about the radius of a fillet of a tenon on the blade tip.

7. A jig as claimed in claim 1 wherein the elongated segment includes a straight edge for location adjacent an axial edge of radially adjacent blades.

8. A jig as claimed in claim 1 wherein the interlocking means includes nut and bolt means, apertures between the elongated segment and fingers permitting relative movement in different transverse directions relative to the axis of shank of the bolt means, the bolt means being directed transversely relative to a plane of the segments and the fingers.

9. A jig as claimed in claim 1 wherein the elongated segment is a rigid curved element conforming to the blade tip periphery curvature of adjacent blade tips.

10. A jig as claimed in claim 1 wherein the elongated segment includes a flexible element, the element conforming to the blade tip periphery curvature of adjacent blade tips when located on the tips of the blades, and the element being adapted for flattened location for interengagement with a flat shroud band for the blades prior to imparting curvature to the shroud band.

11. A jig as claimed in claim 1 including at least five spaced fingers.

12. A turbine blade having a long arc shroud wherein the relative location between adjacent tenons located at tips of adjacent blades of a turbine is shrouded with a band, the band having been fitted by a method of location an elongated segment adjacent a plurality of adjacent blade tips; fitting apertured fingers with the segment with tenons; locking the fingers with the elongated segment such that the apertures define the relative location o the tenons and the fingers and the elongated segment being relatively non-movable in the locked relationship; locating the fingers on a shroud band; and demarcating the band with the relative location of the apertures of the fingers thereby transferring to the shroud band the relative location of the tenons.

13. A blade as claimed in claim 12 wherein there are at least twenty blades in a shrouded group.

14. A blade as claimed in claim 13 wherein there are at least ninety blades in the shrouded group.

15. A method of transferring the relative location between adjacent tenons located at tips of adjacent blades of a turbine comprising;

locating an elongated segment adjacent an axial edge of a plurality of adjacent blades, the elongated segment being adjacent to the blade tips;

fitting apertured fingers with the tenons;

locking the fingers with the elongated segment such that the apertures define the relative location of the tenons;

locating the fingers on a shroud band; and demarcating the band with the relative location of the apertures of the fingers thereby transferring to the shroud band the relative location of the tenons.

16. A method as claimed in claim 15 wherein transferring the relative location transfers the pitch of the tenons to the band, the tenons being non-movable relative to each other.

17. A method as claimed in claim 16 wherein transferring the relative location transfers the axial and radial location of the tenons.

18. A method as claimed in claim 15 including laying a conforming rigid elongated element on the blade tips, the blade tips defining an arc of curvature, and thereafter laying the elongated segment and fingers on a conforming curved shroud band.

19. A method as claimed in claim 15 including laying a flexible elongated segment on the blade tips, the blade tips defining an arc of curvature, extending the elongated segment onto a flat band after locking the fingers, and curving the band to conform to the blade tips.

20. A method as claimed to be claim 15 wherein adjacent blades define adjacent groups, and the elongated segment is progressively located over adjacent groups thereby to transfer progressively the relative location of adjacent blade tips.

21. A method as claimed in claim 20 where each group defines a trailing end blade and a leading end blade, and wherein the elongated member is progressively located so that the trailing end of one group is a leading end of an adjacent group.

22. A method as claimed in claim 20 wherein each group contains at least five blades.

23. A method as claimed in claim 20 wherein each group extends over at least fifteen blades.

24. A method as claimed in claim 20 wherein there are at least forty blades in an arc shroud.

25. A method as claimed in claim 20 wherein there are at least ninety blades in an arc shroud.

26. A method as claimed in claim 15 including forming apertures in the band progressively to fit with the tenons.

27. A method as claimed in claim 26 including progressively fitting blades in a selected group and thereafter repeating the procedure for a next group of blades.

28. A method as claimed in claim 26 including peening the tenon tips thereby fixing a band to the tenons.

29. A method as claimed in claim 26 including adjusting for growth in the band by selectively moving the band towards a leading edge of an adjacent previously transferred set of tenons.

30. A method as claimed in claim 29 including moving the band a predetermined amount.

31. A method as claimed in claim 30 wherein the band is moved at least about 0.001 inch per adjacent aperture.

32. A method as claimed in claim 29 including effecting adjustment with the fingers in relationship such that the leading tenon of a group of tenons is the trailing tenon of an adjacent group.

33. A method as claimed in claim 15 including forming apertures by interaction of the band from an inside surface adjacent to the blade tip in a direction away from the blade.

34. A method as claimed in claim 15 including laying the fingers over the tenons prior to locking the fingers in position in the elongated segment such that the outer surface of the fingers and tenons define a convex surface, locating the elongated segment such that the surface of the elongated segment presents a concave face, locating a band in adjacency with the elongated element such that the fingers are located over the band, transferring the location of apertures in the fingers to the band, forming apertures in the band, progressively repeating the process until multiple apertures are formed in a single band, and securing the band to the respective tenons to form a long arc shroud.

35. A method of transferring the relative location between adjacent tenons located at tips of adjacent blades of a turbine comprising:

locating an elongated segment adjacent an axial edge of a plurality of adjacent blades, the elongated segment being adjacent to the blade tips;

fitting apertured fingers with the tenons;

locking the fingers with the elongated segment such that the apertures define the relative location of the tenon and wherein in the locked relationship, the elongated segment and fingers are relatively nonmovable;

locating the fingers on a shroud band; and demarcating the band with the relative location of the apertures of the fingers thereby transferring to the shroud band the relative location of the tenons.

36. A method as claimed in claim 35 wherein transferring the relative location transfers the pitch of the tenons and the axial and radial location of the tenons to the band.

37. A method as claimed in claim 36 wherein adjacent blades define adjacent groups, and the elongated segment s progressively located over adjacent groups thereby to transfer progressively the relative location of adjacent blade tips.

38. A method as claimed in claim 36 where each group defines a trailing end blade and a leading end blade, and wherein the elongated member is progressively located so that the trailing end of one group is a leading end of an adjacent group.

39. A method as claimed in claim 36 including forming apertures in the band progressively to fit with the tenons.

40. A method as claimed in claim 36 including peening the tenon tips thereby fixing a band to the tenons.

* * * * *